US006161704A

United States Patent [19]

Stravitz

[11] Patent Number: 6,161,704

[45] **Date of Patent: *Dec. 19, 2000**

[54] FILE FOLDER RACK WITH STEPPED SUPPORTS

[76] Inventor: David M. Stravitz, 16 Park Ave. - Suite 14A, New York, N.Y. 10016

[ * ] Notice: This patent issued on a continued prosecution application filed under 37 CFR 1.53(d), and is subject to the twenty year patent term provisions of 35 U.S.C. 154(a)(2).

[21] Appl. No.: 09/184,829

[22] Filed: Nov. 2, 1998

[51] Int. Cl.[7] ..... A47F 7/16; B42F 7/10

[52] U.S. Cl. ..... 211/45; 211/50; 211/189

[58] Field of Search ..... 211/45, 40, 42, 211/189, 50, 52, 65

[56] References Cited

U.S. PATENT DOCUMENTS

| | | | |
|---|---|---|---|
| D. 405,115 | 2/1999 | Stravitz | D19/90 |
| 638,785 | 12/1899 | Whittlesey | 211/40 X |
| 1,821,621 | 9/1931 | Durand | 211/40 |
| 3,315,814 | 4/1967 | Korsen | 211/45 |
| 3,854,589 | 12/1974 | Saltz | 211/45 |
| 4,776,463 | 10/1988 | Press | 211/40 X |
| 5,031,779 | 7/1991 | Szenay et al. | 211/40 |
| 5,333,741 | 8/1994 | Yang | 211/40 |
| 5,346,074 | 9/1994 | Overholser | 211/40 |
| 5,558,235 | 9/1996 | Hunt | 211/40 |
| 5,615,779 | 4/1997 | Marsilio et al. | 211/40 |

*Primary Examiner*—Daniel P. Stodola
*Assistant Examiner*—Erica B. Harris
*Attorney, Agent, or Firm*—Frishauf, Holtz, Goodman, Langer & Chick, P.C.

[57] ABSTRACT

A file folder rack includes a left side wall including a left rear section at a first height, and a left support section connected with the rear section and being at a much lower height than the rear section, the support section having an upper surface with a plurality of first recesses therein, with the first recesses being staggered at different heights which increase from a front to a rear of the rack and a highest one of the recesses being at a much lower height than the rear section; a right side wall including a right rear section at the first height, and a right support section connected with the right rear section and being at a much lower height than the right rear section, the right support section having an upper surface with a plurality of second recesses therein, with the second recesses being staggered at different heights which increase from a front to a rear of the rack and a highest one of the second recesses being at a much lower height than the right rear section, and the first and second recesses being in alignment with each other and at the same heights as each other so as to support file folders therein such that the file folders are further supported by leaning against the left and right rear sections; and cross bars interconnecting the left and right side walls in a substantially parallel relation.

17 Claims, 3 Drawing Sheets

FILE FOLDER RACK WITH STEPPED SUPPORTS

BACKGROUND OF THE INVENTION

The present invention relates to storage racks for holding articles such as file folders, or the like, and more particularly, is directed to such a rack with stepped supports for supporting files, file folders or the like in a tiered arrangement. The invention is described below with respect to file folder racks, but is not limited to use only with file folders or the like.

Plastic file folder organizers or racks for office and home use are well known. Such file folder organizers are generally molded to have fixed compartments therein. These file folder organizers or racks are generally bulky and require additional material to create the different compartments. Further, the files are not always readily viewable and accessible.

Further, the shelves in such file folder organizers or racks are generally of a fixed nature. If an item is too large to fit on a shelf, a different file folder organizer must be used. In like manner, if small items are provided, the small items may be too small for the shelves and may not fit properly therein or may fall down on the shelves.

Various devices are known which have an upwardly inclined wall having recesses therein for storing items. Examples of such devices are disclosed in U.S. Pat. No. Des 193,647 (Michaud), U.S. Pat. No. Des 256,253 (Suljic), U.S. Pat. No. Des 315,746 (Christensen), U.S. Pat. No. Des 601,753 (Kaiser), and U.S. Pat. No. 632,876 (Meaker, Jr.). However, in these prior art devices, the recesses all face forward, such that there is no forward supporting wall for the articles placed therein. As a result, the articles are held only by the recess walls.

SUMMARY OF THE INVENTION

Accordingly, it is an object of the present invention to provide a rack for file folders and the like that overcomes the aforementioned problems.

It is another object of the present invention to provide such a rack which provides easy viewing of the files or other articles in a tiered arrangement.

It is still another object of the present invention to provide such a rack that has great balance and stability, even when only a few files or other articles are held therein.

It is yet another object of the present invention to provide such a rack for file folders or the like that is easy and economical to make and use.

According to the present invention, a rack for file folders or the like includes a left side wall including a left rear section at a first height, and a left support section connected with the left rear section and being at a much lower height than the rear section, the support section having an upper surface with a plurality of first recesses therein, with the first recesses being staggered at different heights which increase from a front to a rear of the rack and a highest one of the recesses being at a much lower height than the rear section; a right side wall including a right rear section at the first height, and a right support section connected with the right rear section and being at a much lower height than the right rear section, the right support section having an upper surface with a plurality of second recesses therein, with the second recesses being staggered at different heights which increase from a front to a rear of the rack and a highest one of the second recesses being at a much lower height than the right rear section, and the first and second recesses being in alignment with each other and at the same heights as each other so as to support articles such as file folders therein such that the articles are further supported by leaning against the left and right rear sections; and at least one connecting member interconnecting the left and right side walls in a substantially parallel relation.

The left side wall includes a left front section connected with the left support section such that the left support section is interposed between the left front section and the left rear section, and the right side wall includes a right front section connected with the right support section such that the right support section is interposed between the right front section and the right rear section. Preferably, the left and right front sections and the left and right rear sections are the same height, with the left and right front sections and the left and right rear sections have trapezoidal configurations, and the left and right support sections have trapezium configurations. The left and right rear sections have front sides that are inclined upwardly and rearwardly.

The left, right and support sections of the left and right side walls are formed by planar walls, and include horizontal perimetrical flanges surrounding and connected to the planar walls.

The recesses are substantially U-shaped recesses.

Each of the front and rear sections of each of the left and right side walls includes a socket, and each connecting member includes a cross bar having a left end that fits within a socket of the left side wall and a right end that fits within a socket of the right side wall. Each socket includes a side opening, and the left and right ends of the cross bar each include a bendable finger having a catch at a free end thereof for engagement within the side opening so as to lock the cross bar in the sockets.

The above and other objects, features and advantages of the present invention will become readily apparent from the following detailed description thereof which is to be read in connection with the accompanying drawings.

DETAILED DESCRIPTION

Figure 1:
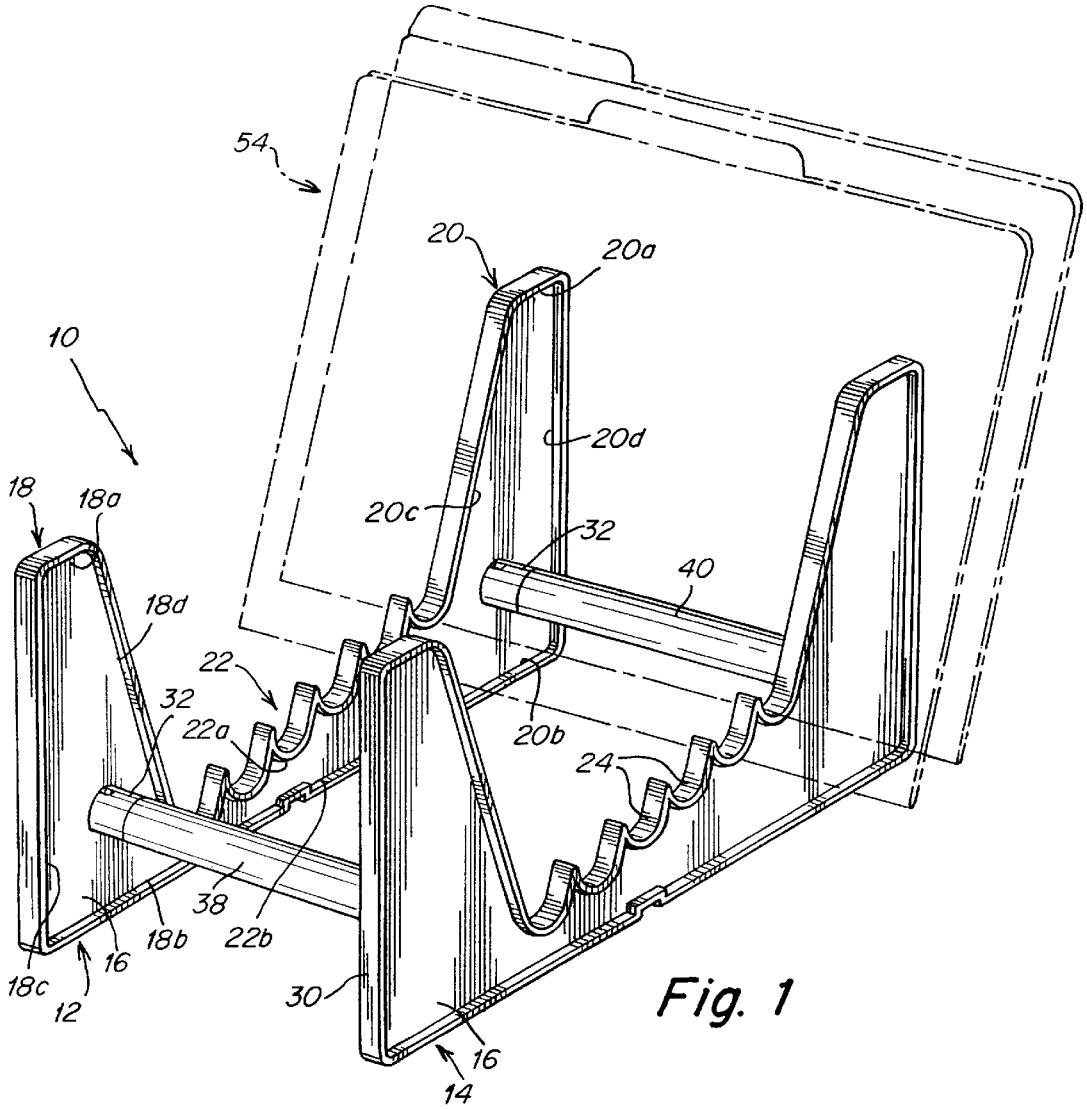
FIG. 1 is a perspective view of a file folder rack according to the present invention, with two file folders shown in phantom lines.
Figure 2:
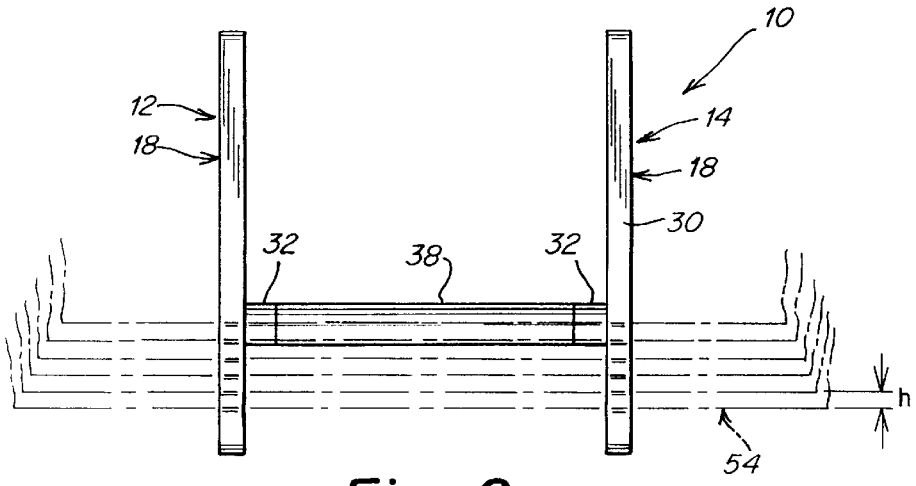
FIG. 2 is a front elevational view of the file folder rack, with the bottom portions of a plurality of file folders shown in phantom.

Referring to the drawings in detail, a file folder rack 10 according to the present invention includes left and right side walls 12 and 14 of the same shape and dimensions. Specifically, each side wall 12 and 14 includes a planar or plate portion 16 formed with a front trapezoid section 18, a rear trapezoid section 20 and an intermediate trapezium section 22 that connects front and rear trapezoid sections 18 and 20.

Front trapezoid section 18 has parallel upper and lower sides 18*a* and 18*b* with upper side 18*a* being of a lesser length than lower side 18*b*, measured from front to back, a front side 18*c* that interconnects front edges of upper and lower sides 18*a* and 18*b* at right angles, and a rear side 18*d* that interconnects rear edges of upper and lower sides 18*a* and 18*b* and extends at an obtuse angle with upper wall 18*a* and at an acute angle with lower wall 18*b*.

In like manner, rear trapezoid section 20 has parallel upper and lower sides 20*a* and 20*b* with upper side 20*a* being of a lesser length than lower side 20*b*, measured from front to back, a rear side 20*d* that interconnects rear edges of upper and lower sides 20*a* and 20*b* at right angles, and a front side 20*c* that interconnects front edges of upper and lower sides 20*a* and 20*b* and extends at an obtuse angle with upper wall 20*a* and at an acute angle with lower wall 20*b*. Further upper and lower sides 20*a* and 20*b* are parallel and preferably in alignment with upper and lower sides 18*a* and 18*b*, respectively, of front trapezoid section 18.

Intermediate trapezium section 22 has upper and lower sides 22*a* and 22*b* with lower side 22*b* being parallel, in alignment with and connected to lower sides 18*b* and 20*b*. Accordingly, lower sides 18*b*, 20*b* and 22*b* form a continuous lower wall for supporting file folder rack 10 upon a surface. Upper side 22*a* extends for the same front to back distance as lower side 22*b* but is inclined downwardly from rear trapezoid section 20 toward front trapezoid section 18. The front side 22*c* of intermediate trapezium section 22 is contiguous with rear side 18*d* of front trapezoid section 18, and the rear side 22*d* of intermediate trapezium section 22 is contiguous with front side 20*c* of rear trapezoid section 20.

Figure 3:
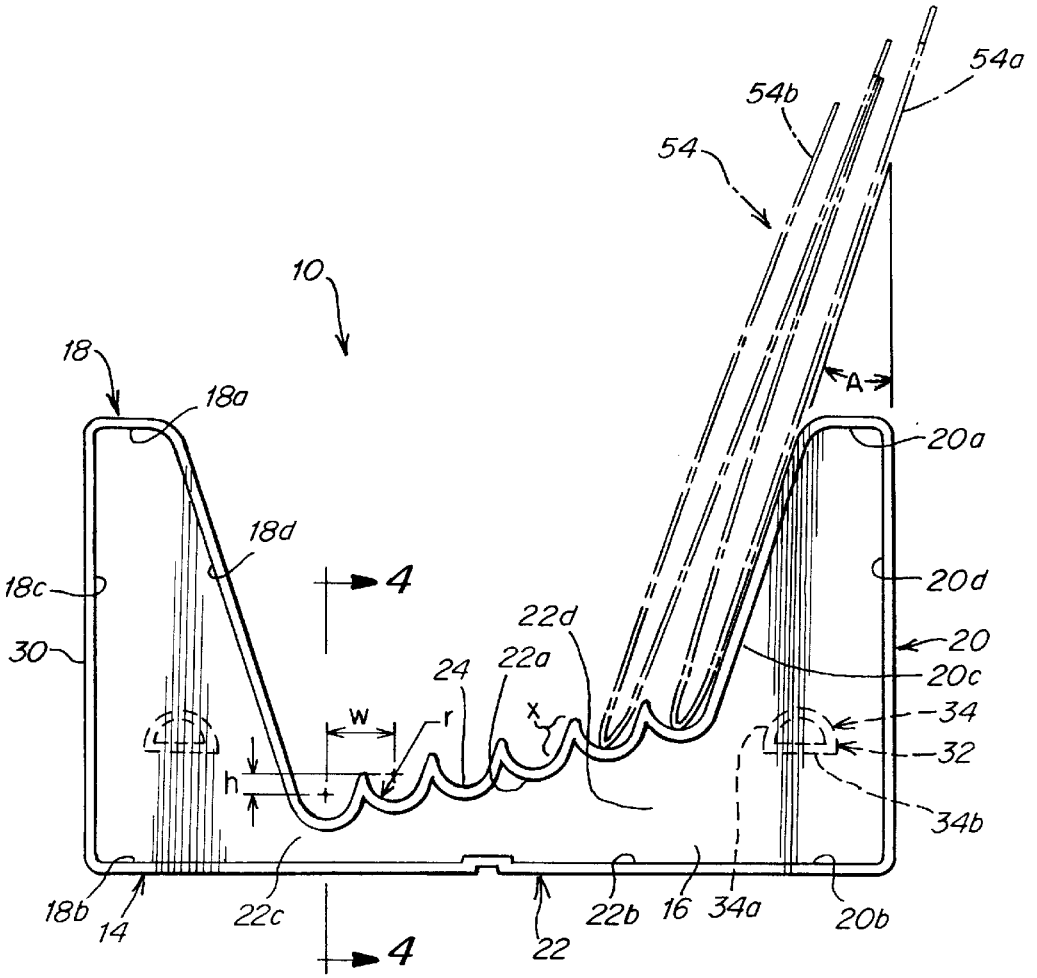
FIG. 3 is a right side elevational view of the file folder rack, with two file folders shown in phantom lines.
Figure 4:
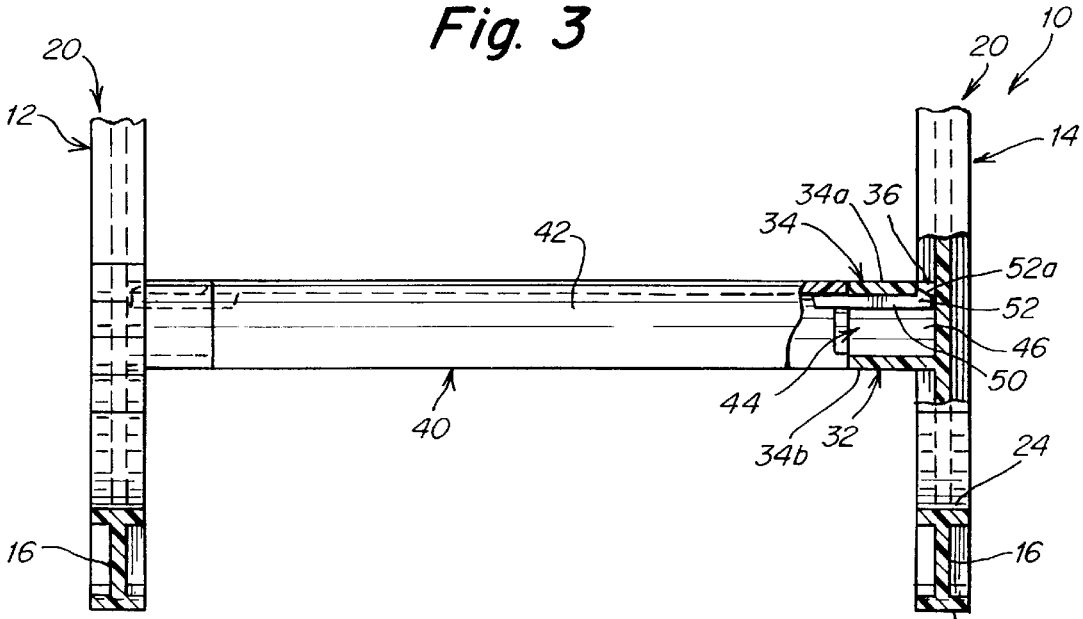
FIG. 4 is cross-sectional view of the file folder rack of FIG. 3, taken along line 4—4 thereof, with the socket and cross bar being shown in partial cross-section also to show the attachment.
Figure 5:
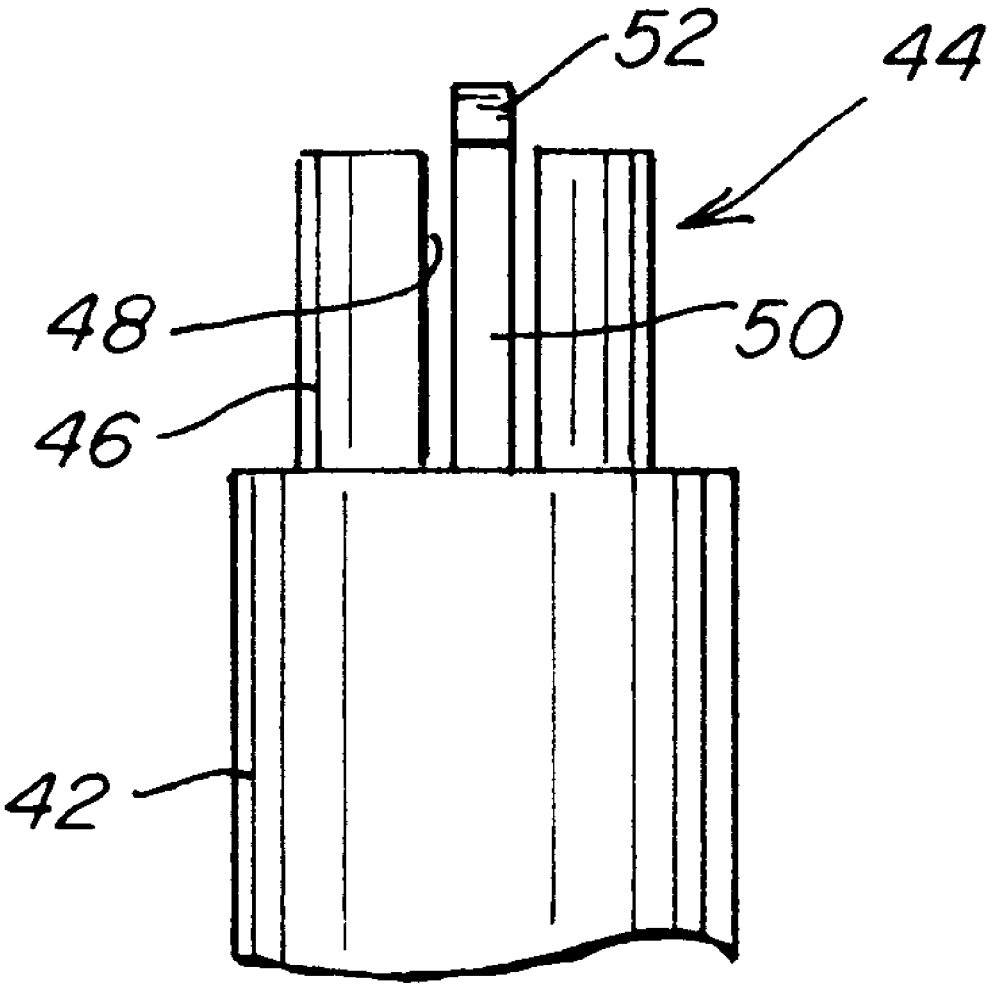
FIG. 5 is a top plan view of an end of a cross bar and end connecting member.

Further, upper side 22*a* of intermediate trapezium section 22 has a plurality of generally U-shaped recesses 24 therein of the same or substantially the same depth. Although six such recesses 24 are shown, the present invention is not limited thereby. It will be appreciated that, because of the inclined nature of upper wall 22*a*, recesses 24 are tiered or staggered relative to each other. Recesses 24 can have any suitable dimensions, for example, a radius r of about 7/16 inch, a center to center distance w between recesses 24 of about 1 1/16 inch, and a difference in height h of 9/32 inch to provide the tiered relation, as best shown in FIG. 3. A portion "X" of each recess 24 is substantially flat and extends generally upward (but inclined toward the rear) from the curved portion of recesses 24. The generally upwardly length of the flat portion X is about 3/8 to 1/2 inch.

In order to increase the structural rigidity of side walls 12 and 14, a horizontal flange 30 extends around the entire perimeter of side walls 12 and 14, and is centered thereon so as to extend both inwardly and outwardly of planar portion 16. In addition, flange 30 functions to better support file folder rack 10 on a support surface.

Front and rear trapezoid sections 18 and 20 each include a semi-circular socket 32 extending from the inner surface thereof. Each socket 32 includes a surrounding wall 34 formed by an arcuate, semi-circular section 34*a* and a diametrical section 34b connecting opposite ends of semi-circular section 34*a*. A side wall opening 36 is provided in the center of arcuate section 34*a* where arcuate section 34*a* attaches to planar portion 16.

A front cross bar 38 connects with sockets 32 in front trapezoid sections 18 and a rear cross bar 40 connects with sockets 32 in rear trapezoid sections 20. In this regard, each cross bar 38 and 40 includes a semi-circular wall 42 of the same outer diameter as the outer diameter of semi-circular section 34*a*, and end connecting members 44 that fit within semi-circular sections 34*a* such that semi-circular wall 42 abuts against semi-circular section 34*a* and effectively forms a continuation thereof.

Each end connecting member 44 is formed by a semi-circular wall 46 having an outer diameter similar to, but slightly less than, the inner diameter of semi-circular section 34*a* so as to fit therein. Semi-circular wall 46 is provided with an axial opening 48 in the center thereof, and an axially extending finger 50 with an upturned catch 52 is provided in axial opening 48 and attached at one end to semi-circular wall 42. The upper surface of finger 50 is substantially in line with the outer surface of semi-circular wall 46, while catch 52 extends above this level. Finger 50 is slightly flexible so that as end connecting member 44 is inserted into a socket 32, catch 52 hits against the inner surface of semi-circular section 34*a* and thereby biases finger 50 downwardly. When end connecting member 44 is substantially fully inserted into socket 32, catch 52 reaches and enters opening 36, thereby locking end connecting member 44 in socket 32. In order to aid in the initial entry of end connecting member 44 into socket 32, catch 52 is formed with an inclined upper end 52*a*.

Other types of cross bars and connectors can be used, such as those shown in, for example, U.S. Pat. No. 1,660,210 and U.S. Pat. No. 5,035,332, the entire contents of which are incorporated herein by reference.

With this arrangement, file folder rack 10 is supported by left and right side walls 12 and 14, which are connected together by front and rear cross bars 38 and 40.

In this construction, a plurality of file folders 54 can be arranged in an upright position on rack 10 in a tiered arrangement. Specifically, the first file folder 54*a* is seated in the highest recess 24 and is inclined rearwardly to rest against flange 30 at front side 20*c* of rear trapezoid section 20, as shown in FIG. 3, at an angle A of, for example, 18 degrees. Thereafter, the next file folder 54*b* seats in the next highest recess 24 and is inclined rearwardly to rest against file folder 54*a*. Because of the different heights of recesses 24, file folder 54*a* will be higher than file folder 54*b* by a height h, so that any labels on each file folder can be read, and each file folder 54 can be individually grasped and removed separate from the other file folders 54.

Thus, rack 10 provides easy viewing of the files in a tiered arrangement. In addition, rack 10 has great balance and stability, even when only a few files are held therein.

Having described a specific preferred embodiment of the invention with reference to the accompanying drawings, it will be appreciated that the present invention is not limited to that precise embodiment, and that various changes and modifications can be effected therein by one of ordinary skill in the art without departing from the scope or spirit of the invention as defined by the appended claims.

What is claimed is:

1. A rack comprising:

a left side wall including:

a substantially planar, vertically oriented left rear section, said left rear section including a front side, a rear side and a socket at an inner face thereof, and said front side having an uppermost end at a first height; and a substantially planar, vertically oriented left support section connected with said rear section and being coplanar with said left rear section, said left support section having a greatest height which is less than one-half of said first height of said left rear section, said left support section having an upper surface with a plurality of first shallow recesses therein, with the first recesses being staggered at different heights which increase from a front to a rear of said rack and a highest one of said recesses having a height less than one-half of said first height of said left rear section, each said recess having a substantially U-shape such that, when moving rearwardly along said U-shape, any position thereon is rearwardly with respect to any previous position thereon;

a right side wall including:

a substantially planar, vertically oriented right rear section in parallel and spaced apart from said left rear section, said right rear section including a front side a rear side and a socket at an inner face thereof, and said front side of said right rear section having an uppermost end at said first height; and a substantially planar, vertically oriented right support section connected with said right rear section and being coplanar with said right rear section, said right support section having a greatest height which is less than one-half of said first height of said right rear section, said right support section having an upper surface with a plurality of second shallow recesses therein, with the second recesses being staggered at different heights which increase from a front to a rear of said rack and a highest one of said second recesses having a height less than one-half of said first height of said right rear section, each said recess having a substantially U-shape such that, when moving rearwardly along said U-shape, any position thereon is rearwardly with respect to any previous position thereon, and the first and second recesses being in alignment with each other and at the same heights as each other such that an article supported by said rack must be positioned in two same height recesses of said left and right support sections, said first and second recesses being sufficiently shallow so as to support articles therein such that upper edges of all said articles must be further supported by leaning against the front sides of said left and right rear sections; and at least one connecting member interconnecting said left and right side walls in a substantially parallel relation, said at least one connecting member extending in a direction perpendicular to said first and second planes, said at least one connecting member including a cross bar having a left end that is coupled to the socket of said left side wall and a right end that is coupled to the socket of said right side wall.

2. A rack according to claim 1, wherein said left side wall includes a left front section connected with said left support section such that said left support section is interposed between said left front section and said left rear section, and said right side wall includes a right front section connected with said right support section such that said right support section is interposed between said right front section and said right rear section.

3. A rack according to claim 2, wherein said left and right front sections are the same height, and said left and right rear sections are the same height.

4. A rack according to claim 2, wherein said front, rear and support sections of said left and right side walls are formed by planar walls.

5. A rack according to claim 4, wherein said left and right side walls further include horizontal perimetrical flanges surrounding and connected to said planar walls.

6. A file folder rack according to claim 2, wherein said front sections of each of said left and right side walls include a socket, and said at least one connecting member includes a further cross bar having a left end that fits within the socket of said front section of said left side wall and a right end that fits within the socket of said front section of said right side wall.

7. A rack according to claim 6, wherein each said socket includes a side opening, and said left and right ends of said cross bar each include a bendable finger having a catch at a free end thereof for engagement within the side opening so as to lock said cross bar in said sockets.

8. A file folder rack according to claim 1, wherein said left end of said cross bar fits within the socket of said left side wall, and said right end of said cross bar fits within the socket of said right side wall.

9. A file folder rack according to claim 8, wherein each said socket includes a side opening, and said left and right ends of said cross bar each include a bendable finger having a catch at a free end thereof for engagement within the side opening so as to lock said cross bar in said sockets.

10. A rack according to claim 1, wherein said left and right rear sections have front sides that are inclined upwardly and rearwardly.

11. A rack comprising:

a left side wall including:

a left rear section at a first height and having a socket at an inner face thereof;

a left support section connected with said rear section and being at a much lower height than said rear section, said support section having an upper surface with a plurality of first recesses therein, with the first recesses being staggered at different heights which increase from a front to a rear of said rack and a highest one of said recesses being at a much lower height than said rear section; and a left front section connected with said left support section such that said left support section is interposed between said left front section and said left rear section, said left front section having a socket at an inner face thereof;

a right side wall including:

a right rear section at said first height and having a socket at an inner face thereof;

a right support section connected with said right rear section and being at a much lower height than said right rear section, said right support section having an upper surface with a plurality of second recesses therein, with the second recesses being staggered at different heights which increase from a front to a rear of said rack and a highest one of said second recesses being at a much lower height than said right rear section, and the first and second recesses being in alignment with each other and at the same heights as each other so as to support articles therein such that all said articles in all said recesses are further supported by leaning against said left and right rear sections; and said right side wall includes a right front section connected with said right support section such that said right support section is interposed between said right front section and said right rear section, said right front section having a socket at an inner face thereof;

said left and right front sections and said left and right rear sections have trapezoidal configurations, and said left and right support sections have trapezium configurations; and at least one connecting member interconnecting said left and right side walls in a substantially parallel relation, said at least one connecting member including:

a first cross bar having a left end that is coupled to the socket of said left front section of said left side wall and a right end that is coupled to the socket of said right front section of said right side wall, and a second cross bar having a left end that fits within the socket of said left rear section of said left side wall and a right end that fits within the socket of said right rear section of said right side wall.

12. A rack according to claim 11, wherein said front, rear and support sections of said left and right side walls are formed by planar walls.

13. A rack according to claim 12, wherein said left and right side walls further include horizontal perimetrical flanges surrounding and connected to said planar walls.

14. A rack according to claim 11, wherein said recesses are substantially U-shaped recesses.

15. A rack according to claim 11, wherein said left and right rear sections have front sides that are inclined upwardly and rearwardly.

16. A file folder rack according to claim 11 wherein said left end of said first cross bar fits within the socket of said left side wall, and said right end of said first cross bar fits within the socket of said right side wall.

17. A file folder rack according to claim 16, wherein each said socket includes a side opening, and said left and right ends of said cross bar each include a bendable finger having a catch at a free end thereof for engagement within the side opening so as to lock said cross bar in said sockets.

* * * * *